US008253762B2

(12) United States Patent
Lee

(10) Patent No.: US 8,253,762 B2
(45) Date of Patent: Aug. 28, 2012

(54) DISPLAY APPARATUS AND BRIGHTNESS CORRECTING METHOD THEREOF

(75) Inventor: Sang-hoon Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 580 days.

(21) Appl. No.: 12/418,015

(22) Filed: Apr. 3, 2009

(65) Prior Publication Data

US 2010/0039457 A1 Feb. 18, 2010

(30) Foreign Application Priority Data

Aug. 14, 2008 (KR) ..... 10-2008-0079822

(51) Int. Cl.
*G09G 5/10* (2006.01)
*G09G 3/36* (2006.01)

(52) U.S. Cl. ..... 345/690; 345/102

(58) Field of Classification Search ..... 345/89, 345/102, 690, 697; 349/61–71; 362/97.1–97.4, 362/217.01–225
See application file for complete search history.

(56) References Cited

U.S. PATENT DOCUMENTS 6,760,081 B2 * 7/2004 Takagi ..... 349/38
6,890,087 B2 * 5/2005 Ono ..... 362/260
7,077,557 B2 * 7/2006 Liu ..... 362/629
7,314,288 B2 * 1/2008 Wakabayashi ..... 362/225
2004/0252256 A1 * 12/2004 Hsu et al. ..... 349/67
2005/0062708 A1 * 3/2005 Yoshihara et al. ..... 345/96
2005/0195341 A1 * 9/2005 Koganezawa et al. ..... 349/62
2006/0214904 A1 * 9/2006 Kimura et al. ..... 345/102
2007/0103937 A1 * 5/2007 Kim ..... 362/613
2007/0159448 A1 7/2007 Inuzuka et al.
2007/0236927 A1 * 10/2007 Liu ..... 362/228

FOREIGN PATENT DOCUMENTS

EP 1705636 A1 9/2006
EP 1914713 A1 4/2008

* cited by examiner

*Primary Examiner* — Sumati Lefkowitz
*Assistant Examiner* — Rodney Amadiz
(74) *Attorney, Agent, or Firm* — Sughrue Mion, PLLC

(57) ABSTRACT

A display apparatus and a brightness correcting method thereof are provided. The display apparatus includes: a display panel which displays an image; a backlight assembly which includes at least one light source unit which supplies a light to the display panel; and a brightness correcting unit that corrects a brightness of the image using brightness correction information which is determined based on the brightness of each area of the image.

18 Claims, 5 Drawing Sheets

(A)

| | |
|---|---|
| ROW1 | 1 |
| ROW2 | 0.95 |
| ROW3 | 0.79 |
| ROW4 | 0.85 |
| ROW5 | 0.90 |
| ⋮ | ⋮ |
| ROWn-4 | 0.95 |
| ROWn-3 | 0.82 |
| ROWn-2 | 0.85 |
| ROWn-1 | 0.91 |
| ROWn | 0.93 |

(B)

| | COLUMN1 | COLUMN2 | COLUMN3 | COLUMN4 | COLUMN5 | | COLUMNm-4 | COLUMNm-3 | COLUMNm-2 | COLUMNm-1 | COLUMNm |
|---|---|---|---|---|---|---|---|---|---|---|---|
| ROW1 | 1 | 0.99 | 0.99 | 1 | 0.95 | • • • | 0.91 | 0.94 | 1 | 0.98 | 1 |
| ROW2 | 0.95 | 0.95 | 0.93 | 0.93 | 0.91 | • • • | 0.92 | 0.93 | 0.94 | 0.95 | 0.95 |
| ROW3 | 0.79 | 0.8 | 0.77 | 0.76 | 0.75 | • • • | 0.77 | 0.77 | 0.78 | 0.79 | 0.8 |
| ROW4 | 0.85 | 0.86 | 0.84 | 0.84 | 0.84 | • • • | 0.83 | 0.84 | 0.85 | 0.84 | 0.85 |
| ROW5 | 0.90 | 0.91 | 0.89 | 0.89 | 0.85 | • • • | 0.88 | 0.89 | 0.91 | 0.91 | 0.92 |
| ⋮ | ⋮ | ⋮ | ⋮ | ⋮ | ⋮ | ⋮ | ⋮ | ⋮ | ⋮ | ⋮ | ⋮ |
| ROWn-4 | 0.95 | 0.94 | 0.95 | 0.93 | 0.93 | • • • | 0.95 | 0.95 | 0.95 | 0.95 | 0.95 |
| ROWn-3 | 0.82 | 0.81 | 0.8 | 0.79 | 0.78 | • • • | 0.79 | 0.8 | 0.8 | 0.8 | 0.8 |
| ROWn-2 | 0.85 | 0.86 | 0.83 | 0.83 | 0.82 | • • • | 0.82 | 0.83 | 0.83 | 0.83 | 0.84 |
| ROWn-1 | 0.91 | 0.9 | 0.91 | 0.89 | 0.88 | • • • | 0.88 | 0.89 | 0.91 | 0.91 | 0.91 |
| ROWn | 0.93 | 0.92 | 0.91 | 0.91 | 0.91 | • • • | 0.88 | 0.88 | 0.89 | 0.91 | 0.91 |

FIG. 4

(A)

| | |
|---|---|
| ROW1 | 1 |
| ROW2 | 0.95 |
| ROW3 | 0.79 |
| ROW4 | 0.85 |
| ROW5 | 0.90 |
| ⋮ | ⋮ |
| ROWn-4 | 0.95 |
| ROWn-3 | 0.82 |
| ROWn-2 | 0.85 |
| ROWn-1 | 0.91 |
| ROWn | 0.93 |

(B)

| | COLUMN1 | COLUMN2 | COLUMN3 | COLUMN4 | COLUMN5 | | COLUMNm-4 | COLUMNm-3 | COLUMNm-2 | COLUMNm-1 | COLUMNm |
|---|---|---|---|---|---|---|---|---|---|---|---|
| ROW1 | 1 | 0.99 | 0.99 | 1 | 0.95 | • • • | 0.91 | 0.94 | 1 | 0.98 | 1 |
| ROW2 | 0.95 | 0.95 | 0.93 | 0.93 | 0.91 | • • • | 0.92 | 0.93 | 0.94 | 0.95 | 0.95 |
| ROW3 | 0.79 | 0.8 | 0.77 | 0.76 | 0.75 | • • • | 0.77 | 0.77 | 0.78 | 0.79 | 0.8 |
| ROW4 | 0.85 | 0.86 | 0.84 | 0.84 | 0.84 | • • • | 0.83 | 0.84 | 0.85 | 0.84 | 0.85 |
| ROW5 | 0.90 | 0.91 | 0.89 | 0.89 | 0.85 | • • • | 0.88 | 0.89 | 0.91 | 0.91 | 0.92 |
| ⋮ | ⋮ | ⋮ | ⋮ | ⋮ | ⋮ | ⋮ | ⋮ | ⋮ | ⋮ | ⋮ | ⋮ |
| ROWn-4 | 0.95 | 0.94 | 0.95 | 0.93 | 0.93 | • • • | 0.95 | 0.95 | 0.95 | 0.95 | 0.95 |
| ROWn-3 | 0.82 | 0.81 | 0.8 | 0.79 | 0.78 | • • • | 0.79 | 0.8 | 0.8 | 0.8 | 0.8 |
| ROWn-2 | 0.85 | 0.86 | 0.83 | 0.83 | 0.82 | • • • | 0.82 | 0.83 | 0.83 | 0.83 | 0.84 |
| ROWn-1 | 0.91 | 0.9 | 0.91 | 0.89 | 0.88 | • • • | 0.88 | 0.89 | 0.91 | 0.91 | 0.91 |
| ROWn | 0.93 | 0.92 | 0.91 | 0.91 | 0.91 | • • • | 0.88 | 0.88 | 0.89 | 0.91 | 0.91 |

DISPLAY APPARATUS AND BRIGHTNESS CORRECTING METHOD THEREOF

CROSS-REFERENCE TO RELATED APPLICATION

This application claims priority from Korean Patent Application No. 10-2008-0079822, filed on Aug. 14, 2008 in the Korean Intellectual Property Office, the disclosure of which is incorporated herein by reference.

BACKGROUND OF INVENTION

1. Field of Invention

Apparatuses and methods consistent with the present invention relate to a display apparatus and a brightness correcting method thereof, and more particularly, to a display apparatus and a brightness correcting method which corrects the brightness of an image by using brightness correction information that is determined based on the brightness of each area of an image displayed in a display panel.

2. Description of Related Art

There has been widely used a display apparatus including a liquid crystal display (LCD) panel having advantages of small size, light weight, excellent power efficiency, etc. with a semiconductor technology which has rapidly been developed. Recently, competition regarding slimness of the display apparatus, such as an LCD television, etc., has been accelerated, and one of the most important factors affecting the thickness of the display apparatus is the thickness of a display unit. The display unit of the display apparatus having an LCD panel is mainly configured with the LCD panel in which an image is displayed, and a backlight assembly supplying a light to the LCD panel.

The thickness of the LCD panel is currently sufficiently thin, and there are a lot of technical problems in making it any thinner. On the other hand, the backlight unit occupies a large portion of the thickness of the display unit, and there is much room for improvement in this regard. Accordingly, there have been a lot of efforts in slimming the display apparatus such as the LCD television, etc., by making the thickness of the backlight assembly thinner.

Since the brightness around a light source disposed inside the backlight assembly is brighter than that of a circumference, a light having a uniform brightness fails to be supplied to the LCD panel from the backlight assembly. That is, a light having a non-uniform brightness distribution is supplied from the backlight assembly according to disposition of the light source constituting the backlight assembly, and due to properties of components such as a reflecting sheet, a diffusing plate and an optical sheet assembly. Accordingly, an output image having a distorted brightness instead of the original brightness of an input image may be displayed on the LCD panel. In addition, as the distance between components constituting the backlight assembly is decreased to reduce the thickness of the backlight assembly, a brightness variation of a light supplied from the backlight assembly increases.

To alleviate the brightness variation of the light, a number of the light sources used may be increased, or the diffusing plate having a high diffusing efficiency may be used. However, in this case, a light emitting efficiency is deteriorated, and a manufacturing cost increases.

SUMMARY OF INVENTION

The present invention provides a display apparatus, including: a display panel which displays an image; a backlight assembly which includes at least one light source unit which supplies a light to the display panel; and a brightness correcting unit which uses a brightness correction information which is determined based on the brightness of each area of an image which is displayed in the display panel to correct the brightness of the image.

The brightness correction information may include information which compensates a brightness difference of each area between an input image which is supplied to the display panel, and an output image which is displayed in the display panel.

The backlight assembly may include at least one of a reflecting sheet which reflects a light which is emitted from the light source unit, a diffusing plate which diffuses the light which is emitted from the light source unit, and an optical sheet assembly which improves a property of a light which passes through the diffusing plate.

The light source unit may include at least one of a point light source and a line light source.

The area of the image may include a pixel unit.

The display apparatus may further include a storing unit, wherein the storing unit may store the brightness correction information which is determined in a matrix type of each pixel unit of the image.

The brightness correction information may include at least one of a first brightness correction information which is determined based on a brightness measuring value of the image, and a second brightness correction information which is calculated from the first correction information with a consideration of a disposition of the light source unit.

The display apparatus may further include an image processing unit which processes the image, wherein the brightness correcting unit may be provided to the image processing unit.

The display apparatus may further include a panel driving unit which applies a signal to the display panel to drive the display panel, wherein the brightness correcting unit may be provided to the panel driving unit.

The light source unit may include at least one of a cold cathode fluorescent lamp (CCFL), an external electrode fluorescent lamp (EEFL), a hot cathode fluorescent lamp (HCFL) and a light emitting diode (LED).

The brightness correction information may include information which compensates a brightness difference of each area, or a non-uniform brightness distribution of the image which is displayed in the display panel.

The present invention provides a brightness correcting method of a display apparatus, including: receiving a light from a backlight assembly which includes at least one light source unit, and displaying an image; determining a brightness correction information based on the brightness of each area of the image which is displayed in a display panel; and correcting the brightness of the image by using the brightness correction information.

The brightness correction information may include information which compensates a brightness difference of each area between an input image which is supplied to the display panel, and an output image which is displayed in the display panel.

The backlight assembly may include at least one of a reflecting sheet which reflects a light which is emitted from the light source unit, a diffusing plate which diffuses the light which is emitted from the light source unit, and an optical sheet assembly which improves a property of a light which passes through the diffusing plate.

The light source unit may include at least one of a point light source and a line light source.

The area of the image may include a pixel unit.

The brightness correction information may be determined in a matrix type by each pixel unit of the image.

The brightness correction information may include at least one of a first brightness correction information which is determined based on a brightness measuring value of the image, and a second brightness correction information which is calculated from the first correction information with a consideration of a disposition of the light source unit.

The light source unit may include at least one of a CCFL, an EEFL, an HCFL and an LED.

The brightness correction information may include information which compensates a brightness difference of each area, or a non-uniform brightness distribution of the image which is displayed in the display panel.

BRIEF DESCRIPTION OF DRAWINGS

The present invention will become apparent and more readily appreciated from the following description of the exemplary embodiments, taken in conjunction with the accompanying drawings, in which:

FIG. 4 exemplarily illustrates a brightness correction information according to an exemplary embodiment of the present invention.

DETAILED DESCRIPTION OF EXEMPLARY EMBODIMENTS

Figure 1:
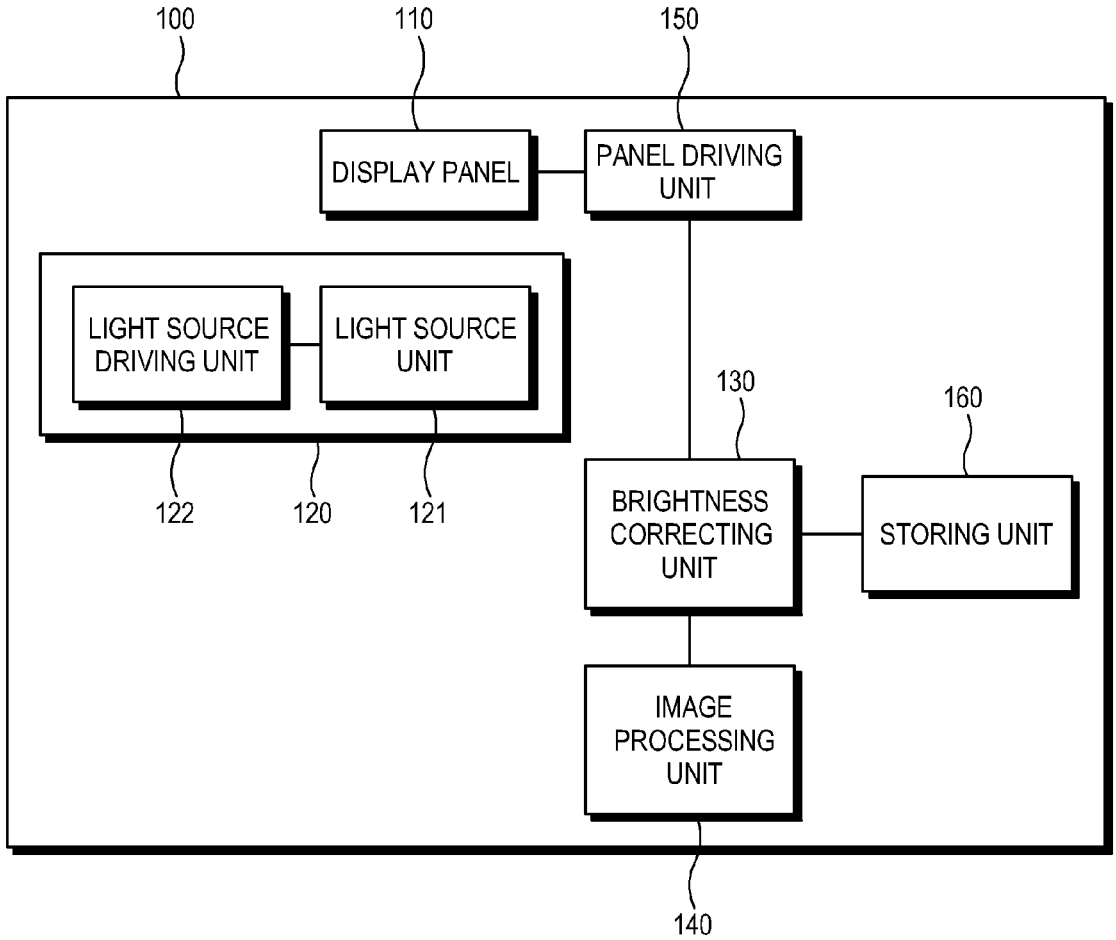
FIG. 1 is a block diagram illustrating a configuration of a display apparatus according to an exemplary embodiment of the present invention.

Reference will now be made in detail to the exemplary embodiments of the present invention, examples of which are illustrated in the accompanying drawings, wherein like reference numerals refer to like elements throughout. The exemplary embodiments are described below so as to explain the present invention by referring to the figures. Repetitive description with respect to like elements of different embodiments may be omitted for the convenience of clarity.

Figure 2:
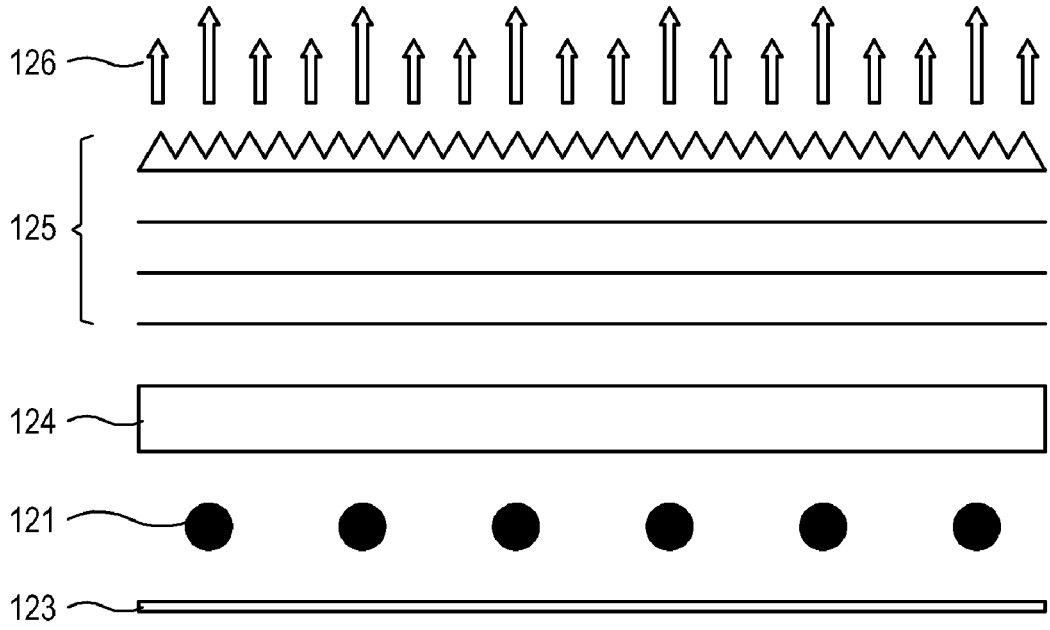
FIG. 2 is a sectional view schematically illustrating a configuration of a backlight assembly according to an exemplary embodiment of the present invention.

FIG. 1 is a block diagram illustrating a configuration of a display apparatus 100 according to an exemplary embodiment of the present invention, and FIG. 2 is a sectional view schematically illustrating a configuration of a backlight assembly 120 according to the exemplary embodiment of the present invention. The display apparatus 100 may be exemplarily implemented as a television, a monitor, etc., and processes an inputted image and displays it.

As shown in FIG. 1, the display apparatus 100 according to the exemplary embodiment of the present invention includes a display panel 110 displaying an image, a panel driving unit 150 driving the display panel 110, a backlight assembly 120 supplying a light to the display panel 110, and a brightness correcting unit 130 correcting the brightness of an image displayed on the display panel 110. Here, the brightness correcting unit 130 corrects the brightness of an image by using a brightness correction information determined based on the brightness of each area of an image displayed in the display panel 110.

Also, the display apparatus 100 further includes an image processing unit 140 processing a video signal in a displayable format, and a storing unit 160 storing the brightness correction information.

The backlight assembly 120 is a backlight of the display panel 110, and includes at least one light source unit 121, and a light source driving unit 122 driving the light source unit 121. Also, as shown in FIG. 2, the backlight assembly 120 includes a reflecting sheet 123 for reflecting a light emitted from the light source unit 121, a diffusing plate 124 for diffusing the light emitted from the light source unit 121, and an optical sheet assembly 125 for improving an optical property of the light passed through the diffusing plate 124.

In the present exemplary embodiment, a direct down light type having a line light source (for example, a cold cathode fluorescent lamp (CCFL)) is exemplarily employed as the backlight assembly 120. However, the light source unit 121 may be provided as a point light source (for example, a light emitting diode (LED)), and the type thereof may be provided as an edge light type. That is, the light source unit 121 may include at least one of a cold cathode fluorescent lamp (CCFL), an external electrode fluorescent lamp (EEFL), a hot cathode fluorescent lamp (HCFL) and a light emitting diode (LED), and may be provided as a point light source or a line light source depending on the type or disposition of a light source. Also, the type of the light source unit 121 may include a direct down light type disposed to a rear side of the display panel 110, and an edge light type disposed to an edge of the display panel 110.

The light source driving unit 122 controls a current supplied to the light source unit 121 so that the light source unit 121 can emit a light having a desired amount.

The reflecting sheet 123 reflects a light emitted from the light source unit 121 in all directions toward the diffusing plate 124. Here, the light may be reflected again to the reflecting sheet 123 from the diffusing plate 124 according to an entering angle thereof, and this reflection may be repeated. The diffusing plate 124 diffuses a light inputted from the light source unit 121 and the reflecting sheet 123 so that the light can uniformly spread to all surfaces of the backlight assembly 120. The optical sheet assembly 125 refracts and collects a light passing through the diffusing plate 124 so that the light can be emitted from a surface of the backlight assembly 120 with a uniform angle. The optical sheet assembly 125 may include a prism sheet (not shown), a reflecting polarizing film (not shown), a diffusing sheet (not shown), etc.

The arrows 126 illustrated in FIG. 2 represent the brightness of a light supplied from the backlight assembly 120. As shown in FIG. 2, since the brightness of a light supplied to a front of the light source unit 121 is brighter than a circumference thereof, the backlight assembly 120 fails to supply a light having a uniform brightness. A disposition of the light source unit 121 is a main cause of the non-uniform brightness, and properties of components such as the reflecting sheet 123, the diffusing plate 124, the optical sheet assembly 125, etc. may also be a cause of the non-uniform brightness.

Figure 3:
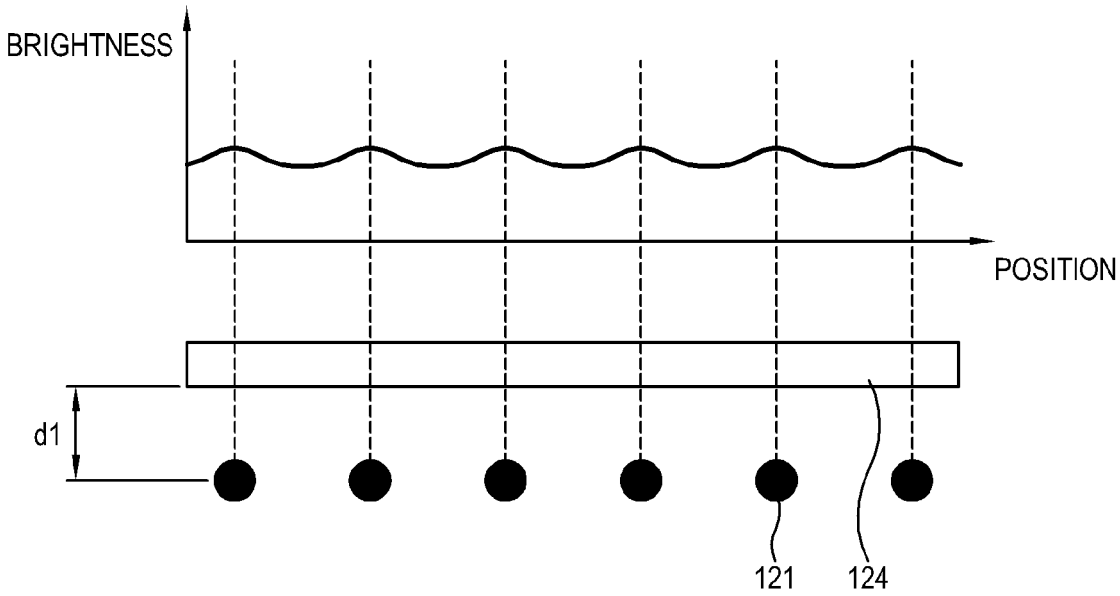
FIG. 3 exemplarily illustrates a brightness variation depending on the distance between a light source unit and a diffusing plate of the backlight assembly.
Figure 3:
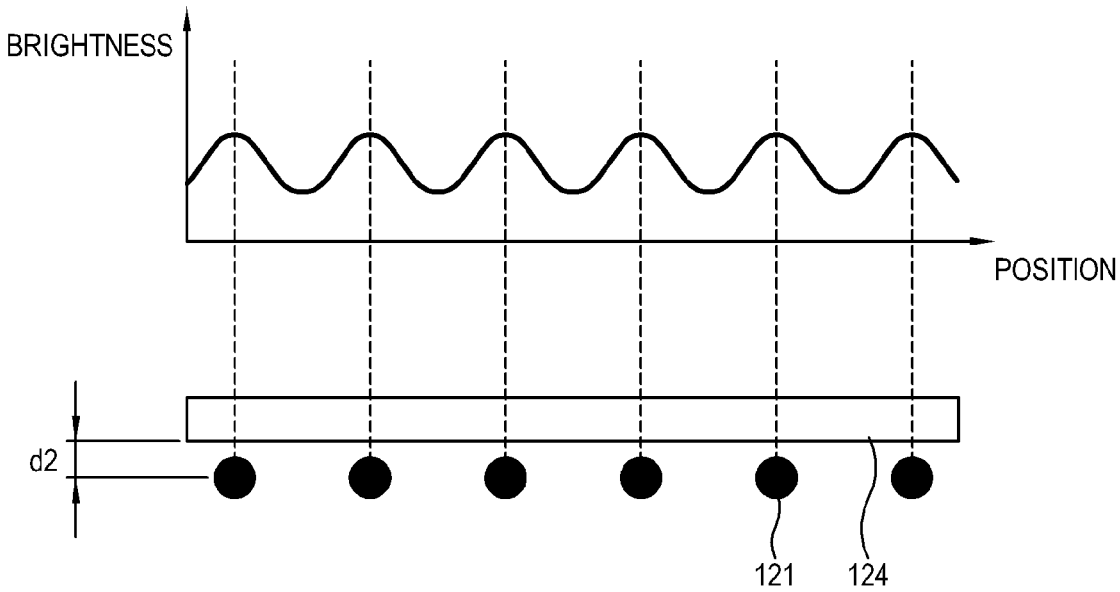

As the distance between components constituting the backlight assembly 120 decreases to reduce the thickness of the backlight assembly 120, a brightness variation of the light described above increases. For example, FIG. 3 exemplarily illustrates a brightness variation depending on the distance between the light source unit 121 and the diffusing plate 124 of the backlight assembly 120. FIG. 3(A) illustrates a case in which the distance between the light source unit 121 and the diffusing plate 124 is large, and FIG. 3(B) illustrates the opposite case of FIG. 3(A). As shown in FIG. 3, as the distance (d1>d2) between the light source unit 121 and the diffusing plate 124 decreases to reduce the thickness of the backlight assembly 120, the brightness variation increases (referring to the graphs). The backlight assembly 120 of the direct down light type having the line light source is exemplarily described. In case of a backlight assembly provided with a point light source like a light emitting diode (LED) or an edge light type, the same phenomenon happens, although a brightness variation pattern is slightly different.

The brightness correcting unit 130 corrects the brightness of an image by using the brightness correction information determined based on the brightness of each area of an image displayed in the display panel 110. The brightness variation in the backlight assembly 120 described above has an effect on the brightness of an image displayed in the display panel 110. That is, there is a brightness difference between an input image supplied to the display panel 110 and an output image actually displayed in the display panel 110. In addition, as described above, the brightness difference increases as the thickness of the backlight assembly 120 decreases. The brightness correcting unit 130 corrects the brightness of an image to compensate the brightness difference between the input image and the output image by using the brightness correction information.

Also, the brightness difference varies depending on the type, number or disposition of the light source unit 121 employed, and varies by each area of the output image depending on properties or dispositions of components constituting the backlight assembly 120 such as the reflecting sheet 123, the diffusing plate 124, the optical sheet assembly 125, etc. Finally, the output image actually displayed on the display panel 110 has a non-uniform brightness per each area.

Accordingly, the brightness correcting unit 130 according to the exemplary embodiment of the present invention corrects the brightness difference of each area or corrects a non-uniform brightness distribution of the output image actually displayed on the display panel 110 according to the brightness correction information. In the present exemplary embodiment, the brightness correction information may include a coefficient of a matrix type for correcting the brightness difference of each area or the non-uniform brightness distribution of the output image actually displayed in the display panel 110.

In the present exemplary embodiment of the present invention, the brightness correction information is determined by measuring the brightness of a light supplied from the backlight assembly 120. The brightness correction information may be determined as a matrix type provided with a coefficient value which is in proportion to the brightness of each area, for example, by each pixel unit of an image displayed in the display panel 110. In the present exemplary embodiment, the brightness correction information may vary depending on the type, number or disposition of the employed light source unit 121, and may be divided by each area depending on properties or dispositions of components composing the backlight assembly 120 such as the reflecting sheet 123, the diffusing plate 124, the optical sheet assembly 125, etc. to be determined in a matrix type.

FIG. 4 exemplarily illustrates the brightness correction information according to the exemplary embodiment of the present invention, and a case in which resolution of an image displayed in the display panel 110 is m (pixel: column)×n (pixel: row) is exemplarily described. As shown in FIG. 4, the brightness correction information is a matrix type corresponding to each pixel of an image, and may be determined as a coefficient value which is in proportion to the brightness of a light supplied from the backlight assembly 120. FIG. 4(B) illustrates an example of the brightness correction information determined in a matrix type to correspond to each pixel of an image.

As shown in FIG. 3, a brightness variation of a light supplied from the backlight assembly 120 is repeated according to a uniform pattern. Accordingly, instead of the brightness correction information corresponding to all pixels of the image, only the brightness correction information corresponding to some rows or columns is determined, and the determined brightness correction information may be repeatedly applied to the brightness correction information corresponding to the rest of the pixels of the image. For example, FIG. 4(A) illustrates an example in which only the brightness correction information about a row among the pixels of an image is determined, and the same brightness correction information is repeatedly applied to each column.

The brightness correcting unit 130 multiplies the brightness correction information determined as described above by a brightness value of each pixel of an image inputted to the display panel 110, and makes it displayed. Accordingly, the display panel 110 can display an output image, where the brightness difference due to the brightness variation of a light supplied from the backlight assembly 120 is compensated.

In the exemplary embodiment of the present invention, the brightness correcting unit 130 is described to be provided as a separate configuration, but may be provided to one of the image processing unit 140 processing a video signal, and the panel driving unit 150 driving a timing controller (not shown) and the display panel 110.

Although not shown, the display apparatus 100 may further include at least one of a tuner for receiving a video signal such as a broadcasting signal, a signal input unit including a connector corresponding to various signal formats for receiving the video signal from an external device such as a digital versatile disk (DVD), a personal computer (PC), etc., an audio processing unit processing an audio signal, an audio outputting unit outputting an audio such as a speaker, etc., a user input unit for receiving a command of a user such as a remote controller, an operation panel, etc., a communicating unit performing communication with a network or other communication device, a power supplying unit for supplying an electric power to each element, a read only memory (ROM), a random access memory (RAM) and a central processing unit (CPU) for totally controlling the above configurations, and a control unit provided with at least one computer program.

Figure 5:
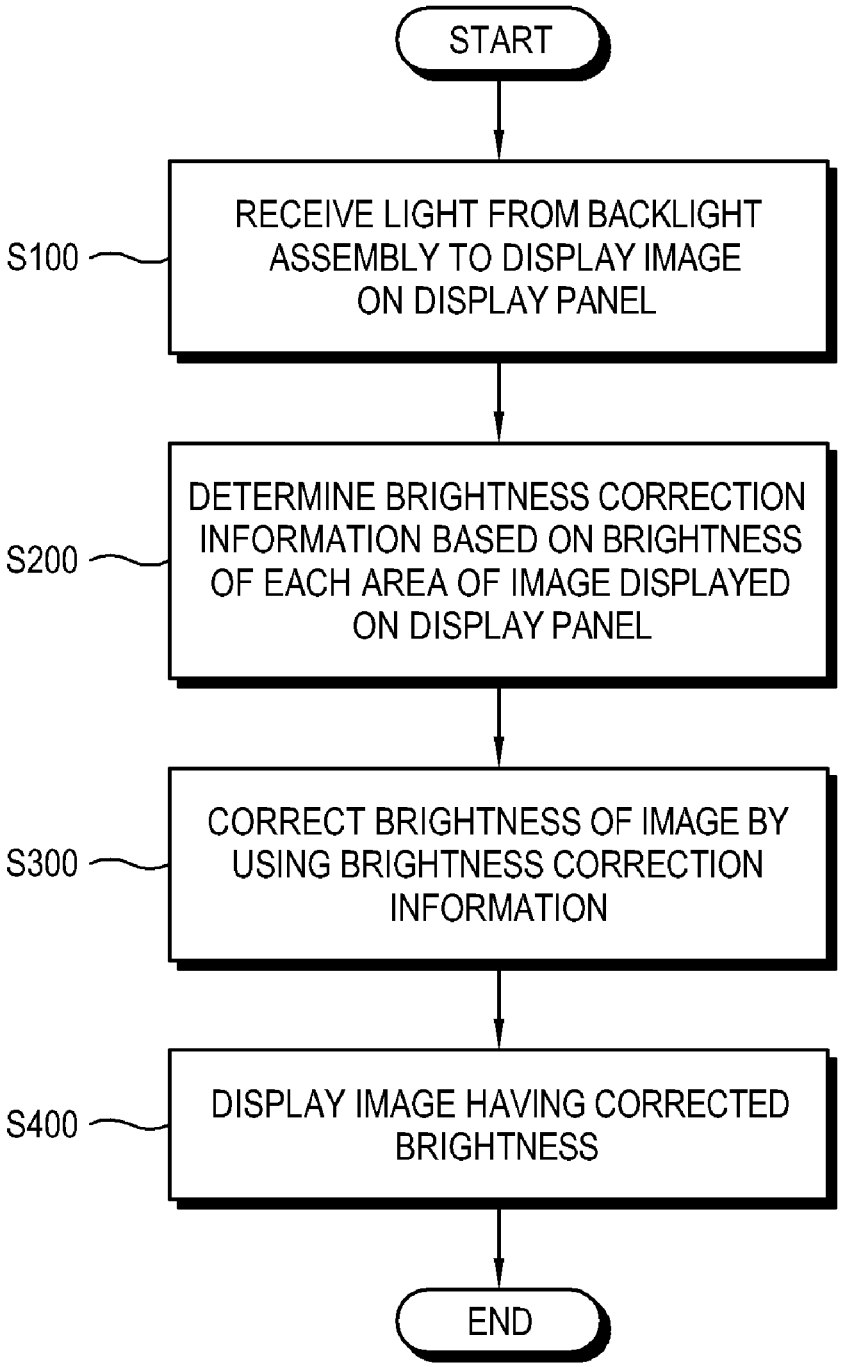
FIG. 5 is a flowchart illustrating a process of a brightness correcting method of a display apparatus according to an exemplary embodiment of the present invention.

FIG. 5 is a flowchart illustrating a process of a brightness correcting method of a display apparatus according to an exemplary embodiment of the present invention.

As shown in FIG. 5, a light is supplied from a backlight assembly 120, and an image is displayed on a display panel 110 (S100). A brightness correction information is determined based on the brightness of each area of the image displayed in the display panel 110, and the determined brightness correction information is stored in a storing unit 160 (S200). The brightness of an image inputted to the display panel 110 is corrected by using the brightness correction information stored in the storing unit 160 (S300). An image, the brightness of which is corrected in a brightness correcting unit 130, is displayed on the display panel 110 (S400).

As described above, a display apparatus and a brightness correcting method of the display apparatus according to the present invention can correct a brightness difference between an input image supplied to a display panel and an output image displayed on the display panel.

Also, a display apparatus and a brightness correcting method of the display apparatus according to the present invention can correct a brightness variation of a light or a non-uniform brightness distribution of an output image displayed on a display panel which may be caused by reducing the distance between components constituting a backlight assembly to reduce the thickness of the backlight assembly. Accordingly, the thickness of the backlight assembly can be sufficiently reduced without distortion of an output image.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A display apparatus comprising:

a display panel which displays an image;

a backlight assembly which comprises at least one light source unit which supplies light to the display panel; and a brightness correcting unit which corrects a brightness of the image according to brightness correction information for each area of the image displayed on the display panel, wherein the backlight assembly comprises at least one component of a reflecting sheet which reflects a light which is emitted from the at least one light source unit, a diffusing plate which diffuses the light which is emitted from the at least one light source unit, and an optical sheet assembly which improves a property of a light which passes through the diffusing plate, and the brightness correction information is determined by dispositions of the component and the at least one light source unit.

2. The display apparatus according to claim 1, wherein the brightness correction information comprises information which compensates a brightness difference of each area between an input image supplied to the display panel and the image displayed on the display panel.

3. The display apparatus according to claim 1, wherein the light source unit comprises at least one of a point light source and a line light source.

4. The display apparatus according to claim 1, wherein the area of the image comprises a pixel unit.

5. The display apparatus according to claim 4, further comprising a storing unit which stores the brightness correction information which is determined in a matrix type for each pixel unit of the image.

6. The display apparatus according to claim 1, wherein the brightness correction information comprises at least one of a first brightness correction information which is determined based on a brightness measuring value of the image, and a second brightness correction information which is calculated from the first brightness correction information with a consideration of a disposition of the light source unit.

7. The display apparatus according to claim 1, further comprising an image processing unit which processes the image, wherein the brightness correcting unit is included in the image processing unit.

8. The display apparatus according to claim 1, further comprising a panel driving unit which applies a signal to the display panel to drive the display panel, wherein the brightness correcting unit is included in the panel driving unit.

9. The display apparatus according to claim 1, wherein the light source unit comprises at least one of a cold cathode fluorescent lamp, an external electrode fluorescent lamp, a hot cathode fluorescent lamp and a light emitting diode.

10. The display apparatus according to claim 1, wherein the brightness correction information comprises information which compensates a brightness difference of each area, or a non-uniform brightness distribution of the image which is displayed on the display panel.

11. A brightness correcting method of a display apparatus, the brightness correcting method comprising:

receiving a light from a backlight assembly which comprises at least one light source unit, and displaying an image on a display panel;

determining brightness correction information for each area of the image which is displayed; and correcting the brightness of the image based on the brightness correction information, wherein the backlight assembly comprises at least one component of a reflecting sheet which reflects a light which is emitted from the at least one light source unit, a diffusing plate which diffuses the light which is emitted from the at least one light source unit, and an optical sheet assembly which improves a property of a light which passes through the diffusing plate, and the brightness correction information is determined by dispositions of the component and the at least one light source unit.

12. The brightness correcting method of the display apparatus according to claim 11, wherein the brightness correction information comprises information which compensates a brightness difference of each area between an input image which is supplied to the display panel and the image which is displayed on the display panel.

13. The brightness correcting method of the display apparatus according to claim 11, wherein the light source unit comprises at least one of a point light source and a line light source.

14. The brightness correcting method of the display apparatus according to claim 11, wherein the area of the image comprises a pixel unit.

15. The brightness correcting method of the display apparatus according to claim 14, wherein the brightness correction information is determined in a matrix type for each pixel unit of the image.

16. The brightness correcting method of the display apparatus according to claim 11, wherein the brightness correction information comprises at least one of a first brightness correction information which is determined based on a brightness measuring value of the image, and a second brightness correction information which is calculated from the first brightness correction information with a consideration of a disposition of the light source unit.

17. The brightness correcting method of the display apparatus according to claim 11, wherein the light source unit comprises at least one of a cold cathode fluorescent lamp, an external electrode fluorescent lamp, a hot cathode fluorescent lamp and a light emitting diode.

18. The brightness correcting method of the display apparatus according to claim 11, wherein the brightness correction information comprises information which compensates a brightness difference of each area, or a non-uniform brightness distribution of the image which is displayed on the display panel.

* * * * *